US005595968A

United States Patent [19]

Gopalkrishnan et al.

[11] Patent Number: 5,595,968

[45] Date of Patent: Jan. 21, 1997

[54] POLYMERIC DISPERSANTS FOR SODA ASH BASED DETERGENT SLURRIES

[75] Inventors: Sridhar Gopalkrishnan, Woodhaven; Kathleen M. Guiney, Wyandotto, both of Mich.

[73] Assignee: BASF Corporation, Mount Olive, N.J.

[21] Appl. No.: 448,281

[22] Filed: May 23, 1995

[51] Int. Cl.[6] ..... C11D 17/00; C11D 7/12; C11D 7/60; C11D 11/02

[52] U.S. Cl. ..... 510/418; 510/337; 510/360; 510/361; 510/434; 510/435; 510/456; 510/476; 510/509

[58] Field of Search ..... 252/174.23, 174.24, 252/DIG. 2, 174, 173, 174.14, 89.1; 510/418, 337, 360, 361, 434, 435, 456, 476, 509

[56] References Cited

U.S. PATENT DOCUMENTS

| | | | |
|---|---|---|---|
| 4,311,606 | 1/1982 | Kaeser | 252/135 |
| 4,362,640 | 12/1982 | Schreiber | 252/135 |
| 4,368,134 | 1/1983 | Kaeser | 252/140 |
| 5,021,525 | 7/1991 | Montague et al. | 526/210 |
| 5,147,576 | 9/1992 | Montague et al. | 252/174 |
| 5,534,183 | 7/1996 | Gopalkrishnan et al. | 510/434 |
| 5,536,440 | 7/1996 | Gopalkrishnan et al. | 510/417 |

FOREIGN PATENT DOCUMENTS

| | | |
|---|---|---|
| 58-5398 | 1/1983 | Japan . |
| 2237813 | 5/1991 | United Kingdom . |
| 9106622 | 5/1991 | WIPO . |
| 9106623 | 5/1991 | WIPO . |
| 9109932 | 7/1991 | WIPO . |

OTHER PUBLICATIONS

Derwent abstract accession No. 89–372253/51, for EP 346 995, Dec. 20, 1989.

*Primary Examiner*—Ardith Hertzog
*Attorney, Agent, or Firm*—Joanne P. Will

[57] ABSTRACT

An aqueous soda ash based detergent slurry composition comprising (A) about 5–65% of inorganic builder salt comprising soda ash, and (B) about 0.01–20% of a copolymer comprising an unsaturated monomer copolymerized with an oxyalkylated monomer.

12 Claims, 1 Drawing Sheet

POLYMERIC DISPERSANTS FOR SODA ASH BASED DETERGENT SLURRIES

FIELD OF THE INVENTION

The present invention relates to copolymers, and more particularly, to soda ash based detergent crutcher slurries that contain the copolymers which permit the reduction of viscosity of such slurries and facilitates their processing during the manufacture of commercial powder detergents.

BACKGROUND OF THE INVENTION

Spray-drying is a typical method of manufacturing powder laundry detergents and involves combining inorganic builder mixtures such as alkali metal bicarbonate, alkali metal carbonate, alkali metal silicate or water-insoluble builders such as zeolite, with water, to form a concentrated slurry. Such slurries typically contain surfactants which are usually anionic in nature, such as linear alkylbenzene sulfonate, alcohol ether sulfates, alcohol sulfates, secondary alkane sulfonates, alphaolefin sulfonates etc. Nonionic surfactants, although not normally included in the crutcher, can be incorporated in the crutcher in small amounts; however, particular attention needs to be devoted to environmental concerns related to "pluming" associated with the spray drying of such slurries. A crutcher composition typically constitutes about 45%–60% solids although it is possible to have a solids content greater than 60% in the crutcher.

Powder detergent compositions typically involve the addition of substantial amounts of alkali metal carbonates, such as sodium carbonate, to the crutcher mix. Alkali metal carbonates, in particular sodium carbonate, can constitute a substantial percentage of the powder detergent formulation, and are added primarily to remove hardness ions such as calcium, via an ion exchange mechanism, and also to provide alkalinity to the wash liquor. In a typical powder detergent manufacturing process, the crutcher mix is processed through a spray tower at very high temperatures to form dry beads. If the detergent formulation contains nonionic surfactants or heat-sensitive ingredients, these additives are sprayed on and absorbed into the dried beads.

A common problem associated with crutcher slurries that contain significant amounts of alkali metal carbonates are their tendency to gel, particularly in the presence of anionic surfactants. This gelling significantly increases the viscosity of the crutcher slurry and makes the crutcher slurry very difficult to process.

In order to reduce the gelation of such slurries for processing, polymeric dispersants have been added to the crutcher mix. Examples of such additives are polycarboxylate polymers such as acrylic polymers and acrylic/maleic copolymers which are added in small amounts, typically about 5% based on the weight of the detergent composition. The addition of polycarboxylates results in the dispersion of solids in the crutcher and thereby reduces the viscosity of the crutcher slurry.

U.S. Pat. No. 4,368,134 teaches the use of water-soluble citric acid salts along with magnesium sulphate to reduce the viscosity of aqueous detergent slurries. U.S. Pat. No. 4,362,640 teaches a method for reducing the viscosity of carbonate based crutcher slurries during the addition of aqueous sodium silicate by adding $CO_2$ with the silicate solution. U.S. Pat. No. 4,311,606 teaches a method of reducing the viscosity of carbonate based crutcher slurries through the addition of sodium sesquicarbonate along with citric acid.

The additives listed in the prior art described above function merely as dispersants and the viscosity reduction achieved via these methods is modest. The inventors have previously found novel polymers useful as stabilizers for the preparation of concentrated built structured liquid detergents. The inventors have now found that these copolymers when incorporated in small amounts in aqueous soda ash based detergent slurries function as dispersants and give a substantial decrease in the viscosity of the slurry.

OBJECTS OF THE INVENTION

It is therefore an object of the present invention to incorporate a copolymer into an aqueous soda ash based detergent slurry composition which will reduce the viscosity of the crutcher slurry composition.

A further object of the invention is to provide a novel, copolymer useful in reducing the viscosity of concentrated soda ash based detergent compositions.

Another object is to provide a method of reducing the viscosity of aqueous soda ash based detergent slurries.

SUMMARY OF THE INVENTION

These and other objects of the invention are achieved by providing an aqueous soda ash based detergent slurry composition which contains about 5–65% of inorganic builder salt comprising soda ash, and about 0.01–20% of a copolymer comprising an unsaturated hydrophilic monomer copolymerized with an oxyalkylated monomer.

The hydrophilic copolymer is preferably of the Formula I or II:

Formula I

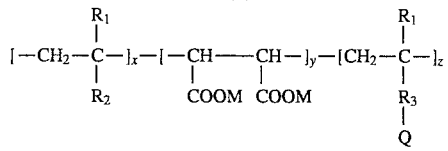

or

Formula II

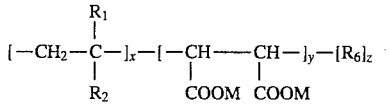

wherein x, y, z, a, and b are integers, (x+y):z is from about 5:1 to 1000:1, and y can be any value ranging from zero up to the value of x; Q is

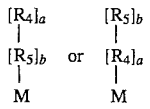

wherein a is about 5–100% and b is about 0–95% of the sum of a+b, and M is an alkali metal or hydrogen;

$R_1$=H or $CH_3$;

$R_2$=COOM, $OCH_3$, $SO_3M$, O—CO—$CH_3$, CO—$NH_2$;

$R_3$=$CH_2$—O—, $CH_2$—N—, COO—, —O—,

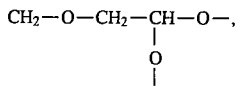

$R_4$=$C_3$ to $C_4$ alkyleneoxy group;

$R_5$=—$CH_2$—$CH_2$—O;

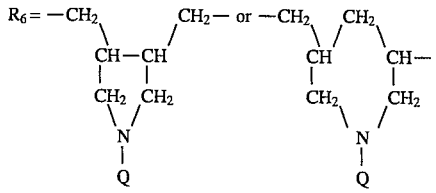

or mixtures of both.

Also provided as part of the invention is a method of reducing the viscosity of aqueous soda ash based detergent slurries which comprises adding thereto about 0.01–20% of at least one copolymer comprising an unsaturated monomer copolymerized with an oxyalkylated monomer, preferably of the above-mentioned formulas.

DETAILED DESCRIPTION OF THE INVENTION

Figure 1:
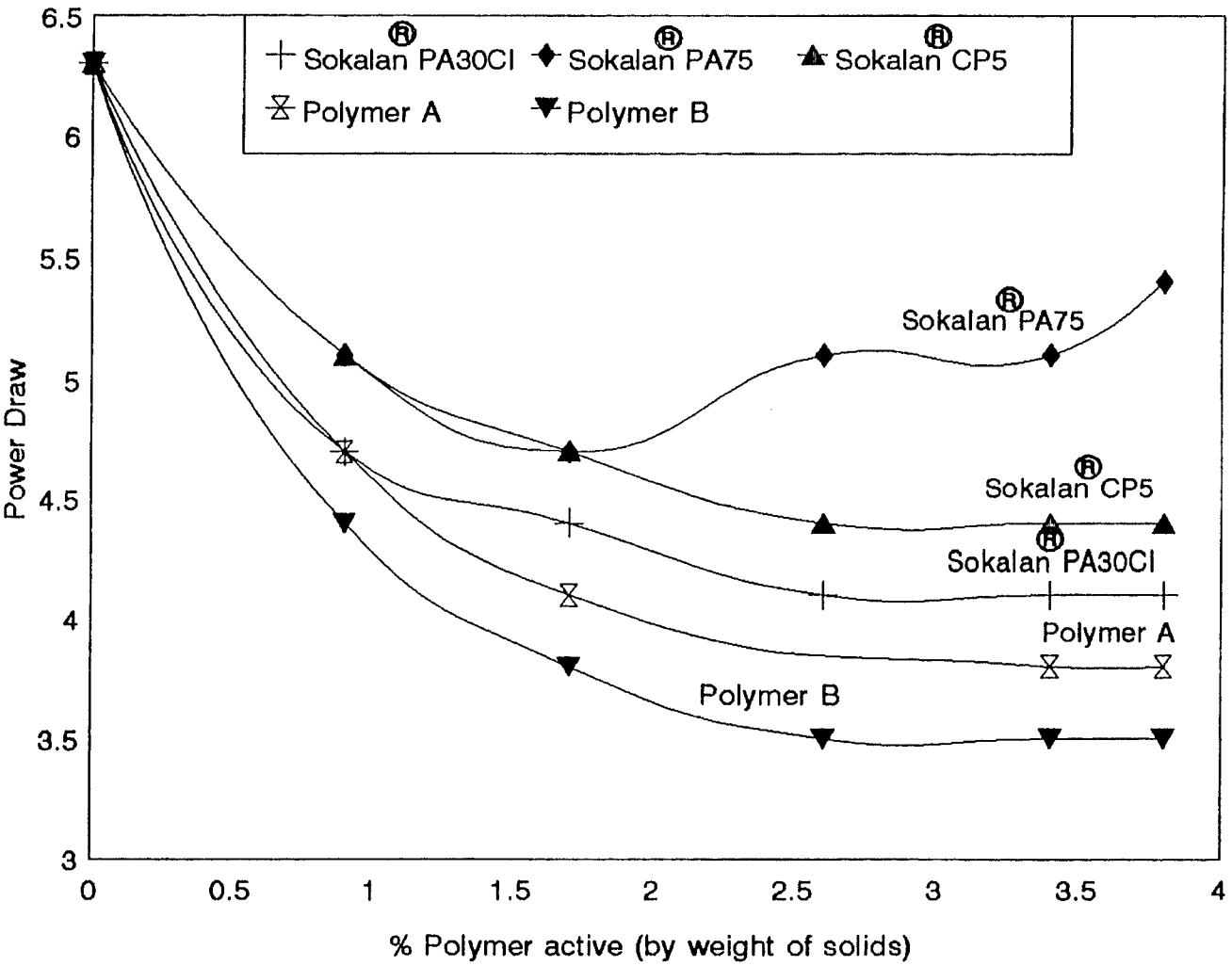
FIG. 1 shows the ability of the copolymers of the invention to reduce the viscosity of aqueous sodium carbonate slurries. The performance of the polymers of this invention is compared to commercially available polymers that are typically added to detergent slurries during the commercial manufacture of powder laundry detergents.

The hydrophlic copolymer is preferably of the formula I or II:

Formula I

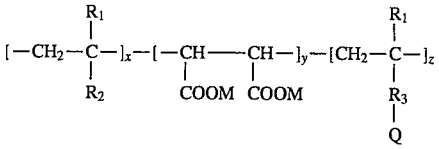

or

Formula II

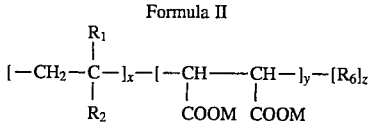

The copolymer is more preferably of Formula I. Substituents x, y, z, a, and b are integers; y can be any value ranging from zero up to the value of x, preferably zero; (x+y):z is from about 5:1 to 1000:1, preferably about 50:1 to 800:1, and more preferably about 100:1 to 500:1. Q is

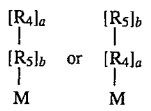

Q is preferably the former structure, and unless otherwise stated, should be considered the former structure herein below. M is hydrogen or an alkali metal, preferably sodium or potassium. The value of a is about 5–100% and b is about 0–95% of the sum of a+b, preferably a is from about 20–80% and b is from about 20–80%. The unsaturated and oxyalkylated monomers in the copolymer are in random order.

$R_1$=H or $CH_3$, preferably H;

$R_2$=COOM, $OCH_3$, $SO_3M$, O—CO—$CH_3$, CO—$NH_2$, preferably COOM;

$R_3$=$CH_2$—O—, $CH_2$—N—, COO—, —O—,

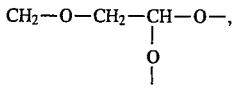

preferably $CH_2$—O—;

$R_4$=$C_3$ to $C_C$ alkyleneoxy group;

$R_5$=—$CH_2$—$CH_2$—O;

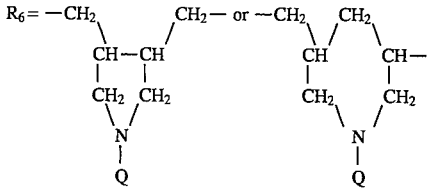

or mixtures of both.

The total molecular weight of the copolymer should be within the range of about 500 to 500,000, as determined by gel permeation chromatography. Preferably, the molecular weight falls within the range of about 1,000 to 100,000; more preferably within the range of about 1,000 to 20,000 (weight average molecular weight - WAMW; unless otherwise specified, molecular weights herein are given in terms of WAMW).

The copolymer of the present invention is prepared by copolymerizing two monomers, an unsaturated monomer copolymerized with an oxyalkylated monomer. These monomers may be randomly distributed within the polymer backbone.

The unsaturated monomer may be selected from the group consisting of acrylic acid, maleic acid, maleic anhydride, methacrylic acid, methacrylate esters and substituted methacrylate esters, vinyl acetate, as well as vinyl acetate copolymerized with said oxyalkylated monomer and hydrolyzed to polyvinyl alcohol, methylvinyl ether, and vinylsulphonate. Preferably, the unsaturated monomer component of the copolymer in formula I or II is acrylic acid. Other useful monomers will include crotonic acid, itaconic acid, as well as vinyl acetic acid.

Examples of the oxyalkylated monomer would be compounds that have a polymerizable olefinic moiety with at least one acidic hydrogen and are capable of undergoing addition reaction with alkylene oxide. It is also possible to include monomers with at least one acidic hydrogen that are polymerized first, and then subsequently oxyalkylated to yield the desired product. For example, allyl alcohol is especially preferred since it represents a monofunctional initiator with a polymerizable olefinic moiety having an acidic hydrogen on the oxygen, and is capable of adding to alkylene oxide. Similarly diallylamine represents another monofunctional initiator with polymerizable olefinic moieties, having an acidic hydrogen on the nitrogen, and is capable of adding to alkylene oxide. Other examples of the oxyalkylated monomer of the copolymer will include reaction products of either acrylic acid, methacrylic acid, maleic acid, or 3-allyloxy-1,2-propanediol with alkylene oxide.

The preferred oxyalkylated monomer is a propylene oxide and ethylene oxide adduct of allyl alcohol. This monomer has a molecular weight of about 3800, and $R_4$ is a propyleneoxy group represented by the formula $—CH_2—CH(CH_3)—O$ and $R_5$ is $—CH_2—CH_2—O$. In this monomer, $R_1$=H, $R_2$=COOM, $R_3$=$CH_2$—O, and y=0. The weight ratio percent of a:b in the oxyalkylated monomer is preferably about 20:80.

Especially preferred oxyalkylated monomer is also a propylene oxide and ethylene oxide adduct of allyl alcohol. This monomer has a molecular weight of about 700, and $R_4$ is a propyleneoxy group and $R_5$ is $—CH_2—CH_2—O$. In this monomer, $R_1$=H, $R_2$=COOM, $R_3$=$CH_2$—O, and y=0. The weight ratio recent of a:b in the oxyalkylated monomer is preferably about 80:20.

The molecular weight of the oxyalkylated monomer according to the various embodiments of the invention will be within the range of about 200 to 30,000, more preferably about 500 to 15,000, and most preferably about 600 to 5000.

The copolymer of the present invention may be added to aqueous soda ash based slurry compositions, hereinafter described, to reduce viscosity thereto.

The copolymer comprises about 0.01 to 20% by weight of the total solids in the slurry composition. Preferably, the copolymer of the invention is about 1% to 14% of a slurry composition; more preferably about 2% to 5% of the slurry composition. (Unless otherwise stated, all weight percentages are based upon the weight of the total solids in the slurry composition).

The slurry composition contains about 5 to about 65% of inorganic builder salt, preferably about 15 to about 55%, and more preferably from about 35 to about 50%. The inorganic builder salt is preferably sodium carbonate, i.e., soda ash.

Optionally, the slurry composition may contain about 0–20%, preferably about 10–15%, of inorganic builder salts other than sodium carbonate, such that the total amount of inorganic builder salt including sodium carbonate is as defined above. The inorganic builder salts may be selected from the group consisting of alkali metal carbonates, alkali metal bicarbonates, alkali metal silicates, alkali metal phosphates, and zeolites. Preferably the slurry composition will contain major amounts of alkali metal carbonates such as sodium or potassium carbonate. The builder material sequesters the free calcium or magnesium ions in water and promotes better detergency. Additional benefits provided by the builder are increased alkalinity and soil suspending properties. Water-insoluble builders which remove hardness ions from water by an ion-exchange mechanism are the crystalline or amorphous aluminosilicates referred to as zeolites. Typical zeolites are univalent cation-exchanging compounds and examples of such crystalline types of zeolites are Zeolite A, Zeolite X or Zeolite Y. The above-mentioned zeolites are typically used as builders in detergent compositions. A more detailed description of such types of zeolites can be found in the Zeolite Molecular Sieves authored by D. W. Breck. Secondary builders such as the alkali metals of ethylene diamine tetraacetic acid, nitrilotriacetic acid can also be utilized in the slurry compositions of the invention. Other secondary builders known to those skilled in the art may also be utilized.

The aqueous soda ash slurry composition can also optionally contain small amounts of surfactants or detergent active matter, that are conventionally employed in cleaning compositions.

The detergent active matter may be selected from the group of anionic, nonionic, cationic, amphoteric and zwitterionic surfactants known to the skilled artisan. Examples of these surfactants may be found in McCutcheon, *Detergents and Emulsifiers* (1993) incorporated herein by reference. Examples of nonionic surfactants will include commonly utilized nonionic surfactants which are either linear or branched and have an HLB of from about 6 to 18, preferably from about 10 to 14. Examples of such nonionic detergents are alkylphenol oxyalkylates (preferably oxyethylates) and alcohol oxyethylates. Examples of the alkylphenol oxyalkylates include $C_6$–$C_{18}$, alkylphenols with about 1–15 moles of ethylene oxide or propylene oxide or mixtures of both. Examples of alcohol oxyalkylates include $C_6$–$C_{18}$ alcohols with about 1–15 moles of ethylene oxide or propylene oxide or mixtures of both. Some of these types of nonionic surfactants are available from BASF Corp. under the trademark PLURAFAC. Other types of nonionic surfactants are available from Shell under the trademark NEODOL. In particular, a $C_{12}$–$C_{15}$ alcohol with an average of 7 moles of ethylene oxide under the trademark NEODOL® 25 - 7 is especially useful in preparing the laundry detergent compositions useful in the invention. Other examples of nonionic surfactants include products made by condensation of ethylene oxide and propylene oxide with ethylene diamine (BASF, TETRONIC® and TETRONIC® R). Also included are condensation products of ethylene oxide and propylene oxide with ethylene glycol and propylene glycol (BASF, PLURONIC® and PLURONIC® R). Other nonionic surface active agents also include alkylpolyglycosides, long chain aliphatic tertiary amine oxides and phosphine oxides.

Typical anionic surfactants used in the detergency art include the synthetically derived water-soluble alkali metal salts of organic sulphates and sulphonates having about 6 to 22 carbon atoms. The commonly used anionic surfactants are sodium alkylbenzene sulphonates, sodium alkylsulphates and sodium alkylether sulphates. Other examples include N-alkylglucosamides, reaction products of fatty acids with isethionic acid and neutralized with sodium hydroxide, sulphate esters of higher alcohols derived from tallow or coconut oil, and alpha-methylestersulfonates.

Examples of amphoylitic detergents include straight or branched aliphatic derivatives of heterocyclic secondary or tertiary amines. The aliphatic portion of the molecule typically contains about 8 to 20 carbon atoms. Zwitterionic detergents include derivatives of straight or branched aliphatic quaternary ammonium, phosphonium or sulfonium compounds.

The slurry compositions heretofore described can be used to manufacture detergent compositions by the addition of ingredients such as nonionic surfactants and other heat-sensitive ingredients, enzymes, anti-redeposition agents, optical brighteners, as well as dyes and perfumes known to those skilled in the art can be added. Other optional ingredients may include fabric softeners, foam suppressants, and oxygen or chlorine releasing bleaching agents.

EXAMPLES

The following examples will serve to demonstrate the efficacy of the copolymer according to various embodiments of the invention. These examples should not be construed as limiting the scope of the invention.

I A. Preparation of Oxyalkylated Monomer (Alkylene Oxide Adduct of Allyl Alcohol)

To a 2 gallon stainless steel autoclave equipped with steam heat, vacuum and nitrogen pressure capability and agitation, a homogenous mixture of 396.2 grams of allyl alcohol and 44.1 grams of potassium t-butoxide was charged. The vessel was sealed, purged with nitrogen and pressurized to 90 psig with nitrogen. The pressure was then relieved to 2 psig and the temperature of the vessel was adjusted to 80° C. The first 125 grams of propylene oxide was added over a 1 hour period. The temperature was maintained between 75°–85° C. and the pressure was maintained at <90 psig. The next 200 grams of propylene oxide was added over a 1 hour period and at 75°–85° C. and <90 psig pressure. The next 400 grams of propylene oxide was added over a 1 hour period at 100°–110° C. and <90 psig pressure. The remaining 4551.2 grams of propylene oxide was charged at 500 grams per hour and at 120°–130° C. and <90 psig pressure. After all of the propylene oxide was added, the mixture was reacted at 125° C. for 2 hours and the vessel was vented to 0 psig. The material was stripped at <10 mm Hg and 125° C. for 1 hour then cooled to 50° C. and discharged into an intermediate holding tank for analysis.

To a 5 gallon stainless autoclave equipped with steam heat, vacuum and nitrogen pressure capability and agitation, 2696.8 grams of the allyl alcohol propylene oxide intermediate was charged. The vessel was sealed and pressurized to 90 psig with nitrogen and vented to 2 psig. This was repeated two more times. The temperature was adjusted to 145° C. and the pressure was readjusted to 34 psig with nitrogen. To the vessel, 10788.9 grams of ethylene oxide was charged at 1400 grams per hour. The temperature was maintained at 140°–150° C. and the pressure was maintained at <90 psig. If the pressure rose above 85 psig, the ethylene oxide addition was slowed. If this failed to lower the pressure, the addition was halted and allowed to react at 145° C. for 30 minutes. The vessel was slowly vented to 0 psig and repadded to 34 psig with nitrogen. The addition was continued at 140°–150° C. and <90 psig pressure. After all of the ethylene oxide was added, the material was held at 145° C. for 1 hour. It was then cooled to 90° C. and 14.3 grams of 85% phosphoric acid was added. The material was mixed for 30 minutes and then vacuum stripped at 100° C. for 1 hour. The batch was cooled to 70° C. and discharged into a holding tank. The product was found to have a number average molecular weight of 4091 by phthalic anhydride esterification in pyridine.

I.B. Polymerization Of Oxyalkylated Monomer With Unsaturated Monomer (Acrylic Acid)

To a two liter, four necked flask equipped with a mechanical stirrer, reflux condenser, thermometer, and outlet for feed lines, were added 301 grams of distilled water and 2.6 grams of 70% phosphorous acid. This solution was heated to 95 degrees centigrade at which time a monomer blend of 555.4 grams of glacial acrylic acid and 61.7 grams of an allyl alcohol initiated propoxylate ethoxylate (I)(molecular weight@3500), a redox initiator system consisting of 132 grams of a 38% sodium bisulfite solution and 155.4 grams of a 10.9% sodium persulfate solution, were fed into the flask linearly and separately while maintaining the temperature at 95+or−3 degrees centigrade. The sodium bisulfite solution and monomer blend feeds were added over 4 hours while the sodium persulfate solution is added over 4.25 hours. The three feeds were added via teflon ⅛ inch tubing lines connected to rotating piston pumps. Appropriately sized glass reservoirs attached to the pumps hold the monomer blend and initiator feeds on balances accurate to 0.1 gram to precisely maintain feed rates. When the additions were complete, the system is cooled to 80 degrees centigrade. At 80 degrees centigrade, 25.3 grams of a 2.4% 2,2'-Azobis (N,N'-dimethyleneisobutyramidine) dihydrochloride solution is added to the system over 0.5 hours as a postpolymerizer. When addition is complete the system was reacted for 2 hours at 80 degrees centigrade. After reaction, the system is cooled to 60 degrees centigrade and the solution pH was adjusted to about 7 with the addition of 658 grams of 50% sodium hydroxide solution. The resultant neutral polymer solution has an approximate solids content of 40%.

II. Viscosity-Reducing Properties

The following experimentation describes the viscosity reducing properties of the copolymers of this invention when added in small amounts to aqueous soda ash based detergent slurry. These examples should not be construed as limiting the scope of the invention.

The sodium carbonate was obtained from the FMC corporation under the name "FMC Grade 100". Polymer A shown in FIG. 1 is a copolymer of acrylic acid with an oxyalkylated allyl alcohol, of Formula I within the scope of the invention. The ratio of acrylic acid to the oxyalkylated allyl alcohol was 90:10 by weight, while the molar ratio was about 474:1. The oxyalkylated monomer component had a molecular weight of about 3800, and $R_4$ was a propyleneoxy group represented by the formula $—CH_2—CH(CH_3)—O$ and $R_5$ was $—CH_2—CH_2—O$. In this monomer, $R_1$=H, $R_2$=COONa, $R_3$=$CH_2$—O, y=0, and the ratio of a:b is 20:80.

Polymer B shown in FIG. 1 is a copolymer of acrylic acid with an oxyalkylated allyl alcohol, of Formula I within the scope of the invention. The ratio of acrylic acid to the oxyakylated allyl alcohol was 93:7, while the molar ratio was about 123:1. The oxyalkylated monomer component had a molecular weight of about 700. Q is of the structure such that $R_5$ is bonded directly to $R_3$; $R_4$ was a propyleneoxy group represented by the formula $—CH_2—CH(CH_3)—O$ and $R_5$ was $—CH_2—CH_2—O$. The ratio of a:b was 80:20 by weight. In this monomer, $R_1$=H, $R_2$=COONa, $R_3$=$CH_2$—O, and y=0.

Sokalan• PA30Cl polymer used in FIG. 1 is a polyacrylic, sodium salt sold with a molecular weight of 8000, commercially by BASF Corporation. Sokalan• PA75 polymer is also a polyacrylic acid sodium salt with a molecular weight of 90,000 available commercially from the BASF Corporation. Sokalan• CP5 polymer is a copolymer of acrylic acid and maleic acid with a molecular weight of 70000, also available from BASF Corporation.

FIG. 1 shows the ability of the copolymers of this invention to reduce the viscosity of aqueous sodium carbonate slurries. The performance of the polymers of this invention is compared to commercially available polymers that are typically added to detergent slurries during the commercial manufacture of powder laundry detergents. The dispersing properties of the copolymers of this invention was evaluated as follows: To a one liter stainless beaker, was added 600 grams of FMC Grade 100 soda ash followed by 400 grams of tap water. The resulting slurry was mixed using a Lightnin• mixer equipped with a digital read out of the rotational speed of the impeller as well as the torque. The torque read out reflects the power in watts required to stir the slurry at a fixed rpm. The rpm in this example was set at 1200. Thus by using this technique one can measure the power drawn by the motor which would be directly proportional to the viscosity of the slurry. The initial torque in the absence of the polymer is noted. Thereafter the polymer additive is added in small increments ranging from 0.5% to 3.8% by weight of the solids in the slurry, to the stirred slurry and the torque readout is then noted. In order to eliminate the effects of dilution, all polymer additives shown in FIG. 1 had the same active polymer content. All evaluations were done at 25° C.

FIG. 1 shows the performance of three commercial polymers available from BASF Corporation under the SOKALAN trade name. FIG. 1 also shows the superior dispersing properties of two copolymers of this invention.

While the invention has been described in each of its various embodiments, it is to be expected that certain modifications thereto may occur to those skilled in the art without departing from the true spirit and scope of the invention as set forth in the specification and the accompanying claims.

What is claimed is:

1. An aqueous soda ash based detergent slurry composition comprising by weight:

(A) about 5–65% of inorganic builder salt comprising soda ash, and (B) about 0.01–20% of a hydrophilic copolymer comprising an unsaturated hydrophilic monomer copolymerized with an oxyalkylated monomer wherein said composition is free of surfactants.

2. The aqueous soda ash based detergent slurry composition of claim 1, wherein said hydrophilic copolymer has at least one of the following formulas:

Formula I

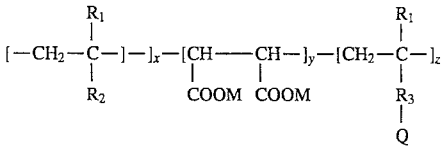

or

Formula II

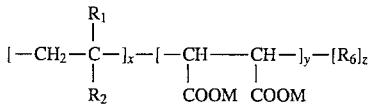

wherein x, y, z, a, and b are integers, (x+y):z is from about 5:1 to 1000:1, and y can be any value ranging from zero up to the value of x; Q is:

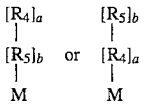

wherein a is about 5–100% and b is about 0–95% of the sum of a+b, and M is an alkali metal or hydrogen;

$R_1$=H or $CH_3$;

$R_2$=COOM, $OCH_3$, $SO_3$, O—CO—$CH_3$, CO—$NH_2$;

$R_3$=$CH_2$—O—, $CH_2$—N—, COO—, —O—

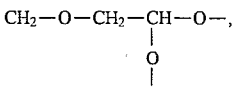

$R_4$=$C_3$ to $C_4$ alkyleneoxy group;

$R_5$=—$CH_2$—$CH_2$—O;

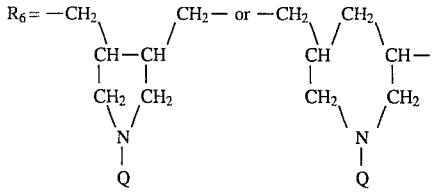

or mixtures of both.

3. The aqueous soda ash based detergent slurry composition of claim 2, wherein said hydrophilic copolymer has a molecular weight within the range of about 500 to 500,000.

4. The aqueous soda ash based detergent slurry composition of claim 3, wherein said hydrophilic copolymer has a molecular weight within the range of about 1000 to 100,000.

5. The aqueous soda ash based detergent slurry composition of claim 4, wherein said hydrophilic copolymer has a molecular weight within the range of about 1000 to 20,000.

6. The aqueous soda ash based detergent slurry composition of claim 2, wherein in said hydrophilic copolymer $R_1$=H, $R_2$=COOM, wherein M is sodium, $R_3$=$CH_2$—O, y=0, a:b is from about 20:80 to 80:20, and the oxyalkylated monomer has a molecular weight of from about 600 to 5000.

7. A method of reducing the viscosity of a surfactant free aqueous soda ash based detergent slurry composition comprising the step of adding thereto about 0.01–10% by weight of a hydrophilic copolymer comprising an unsaturated hydrophilic monomer copolymerized with an oxyalkylated monomer.

8. The method of claim 7, wherein said hydrophilic copolymer has at least one of the following formulas:

Formula I

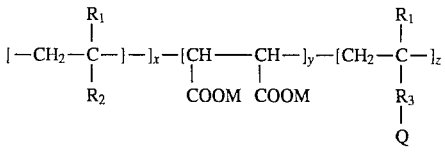

or

Formula II

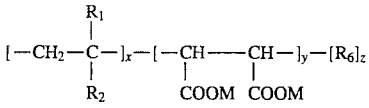

wherein x, y, z, a, and b are integers, (x+y): z is from about 5:1 to 1000:1, and y can be any value ranging from zero up to the value of x: Q is:

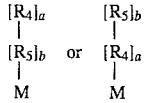

wherein a is about 5–100% and b is about 0–95% of the sum of a+b, and M is an alkali metal or hydrogen;

$R_1$=H or $CH_3$;

$R_2$=COOM, $OCH_3$, $SO_3M$, O—CO—$CH_3$, CO—$NH_2$;

$R_3$=$CH_2$—O—, $CH_2$—N—, COO—, —O—,

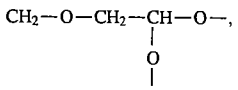

$R_4$=$C_3$ to $C_4$ alkyleneoxy group;

$R_5$=$CH_2$—$CH_2$—O;

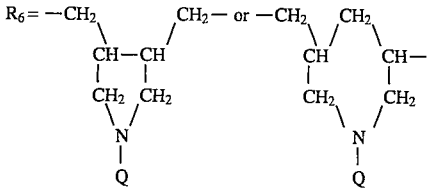

or mixtures of both.

9. The method of claim 8, wherein said hydrophilic copolymer has a molecular weight within the range of about 500 to 500,000.

10. The method of claim 9, wherein said hydrophilic copolymer has a molecular weight within the range of about 1000 to 100,000.

11. The method of claim 10, wherein said hydrophilic copolymer has a molecular weight within the range of about 1000 to 20,000.

12. The method of claim 8, wherein in said hydrophilic copolymer $R_1$=H, $R_2$=COOM, wherein M is sodium, $R_3$=$CH_2$—O, y=0, a:b is from about 20:80 to 80:20, and the oxyalkylated monomer has a molecular weight of from about 600 to 5000.

* * * * *